US005379926A

United States Patent [19]

Mueller et al.

[11] Patent Number: 5,379,926

[45] Date of Patent: Jan. 10, 1995

[54] DISPENSING CLOSURE WITH A TWIST SLEEVE AND TWO INTERNAL PASSAGES

[75] Inventors: Bruce M. Mueller, Brookfield; Richard J. Daniels, Caledonia, both of Wis.; John Elliott, Waukegan, Ill.

[73] Assignee: AptarGroup, Inc., Crystal Lake, Ill.

[21] Appl. No.: 38,909

[22] Filed: Mar. 26, 1993

[51] Int. Cl.[6] ..... B67D 3/00

[52] U.S. Cl. ..... 222/507; 222/532; 222/556

[58] Field of Search ..... 222/503, 505, 507, 531, 222/532, 548, 550, 553, 556

[56] References Cited

U.S. PATENT DOCUMENTS

| | | | |
|---|---|---|---|
| 2,495,015 | 1/1950 | McGrath | 222/507 |
| 2,558,671 | 6/1951 | Cherry | 222/507 |
| 2,779,519 | 1/1957 | Rossetti | 222/507 |
| 3,007,614 | 11/1961 | Morrow | 222/490 |
| 3,357,607 | 12/1967 | Trott et al. | 222/507 |
| 3,703,250 | 11/1972 | Middleton | 222/507 |
| 3,847,313 | 11/1974 | Micallef | 222/507 |
| 4,047,643 | 9/1977 | Hazard | 222/153 |
| 4,141,476 | 2/1979 | Rech | 222/505 |
| 4,190,173 | 2/1980 | Mason et al. | 222/548 X |
| 4,412,634 | 11/1983 | Bennett | 222/519 |
| 4,487,342 | 12/1984 | Shy | 222/556 X |
| 4,591,079 | 5/1986 | Bigotte | 222/505 X |
| 4,776,501 | 10/1988 | Ostrowsky | 222/517 |
| 4,836,423 | 6/1989 | Hayes et al. | 222/257 |
| 4,838,460 | 1/1989 | Moore et al. | 222/153 |
| 4,941,580 | 7/1990 | Julian | 215/235 |
| 4,982,882 | 1/1991 | Gueret | 222/531 |
| 5,004,127 | 4/1991 | Morel | 222/521 |
| 5,044,530 | 9/1991 | Stull | 222/521 |
| 5,065,912 | 11/1991 | Rosenthal | 222/517 |
| 5,199,617 | 4/1993 | Bennett | 222/498 |
| 5,236,107 | 8/1993 | Spaanstra, Sr. | 222/556 X |
| 5,279,451 | 1/1994 | Mueller et al. | 222/507 |
| 5,314,093 | 5/1994 | Gross et al. | 222/556 X |

FOREIGN PATENT DOCUMENTS

| | | | |
|---|---|---|---|
| 952310 | 2/1954 | Germany | 222/507 |
| 2088838 | 6/1982 | United Kingdom | 222/553 |
| 2182027 | 5/1987 | United Kingdom | 222/532 |
| 8700818 | 2/1987 | WIPO | 222/507 |

*Primary Examiner*—Andres Kashnikow
*Assistant Examiner*—Kenneth Bomberg
*Attorney, Agent, or Firm*—Dressler, Goldsmith, Shore & Milnamow, Ltd.

[57] ABSTRACT

A dispensing closure is provided with a body having an outlet passage. A sleeve is mounted on the body for rotation relative to the body. The sleeve has a transverse deck defining a discharge passage for communicating with the body outlet passage as the discharge passage moves in an arc relative to the body. In one embodiment, a seal is provided between the sleeve deck and the body around the outlet passage and discharge passage. In a preferred embodiment, an actuator is mounted on the sleeve for rotation with the sleeve. Engaging structures are defined by the body and actuator for tilting actuator between a closed position and an open position while the actuator is rotated with the sleeve. The actuator includes engaging portions for engagement with drive members projecting upwardly from the body through openings in the sleeve. Engagement between the drive members and actuator is effected on opposite sides of the pivot axis of the actuator so as to effect tilting of the actuator between an open position and a closed position.

14 Claims, 9 Drawing Sheets

Fig. 10
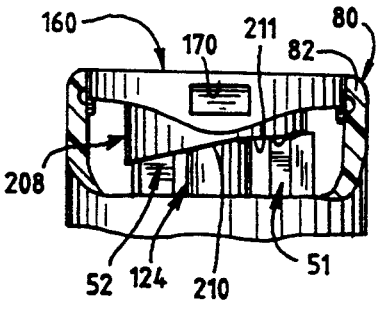
Fig. 11
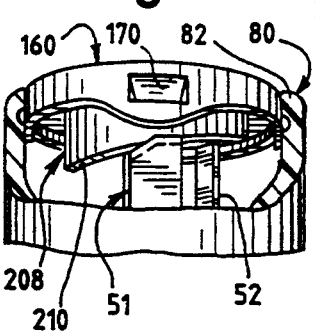
Fig. 12
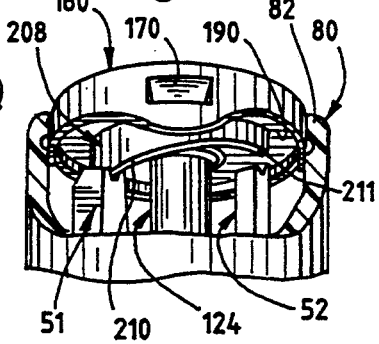
Fig. 13
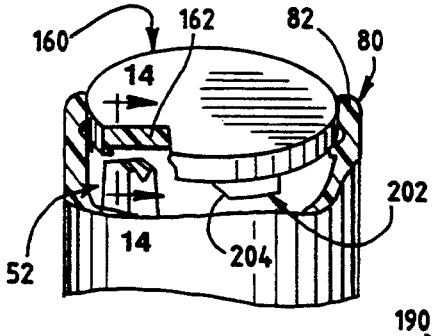
Fig. 17
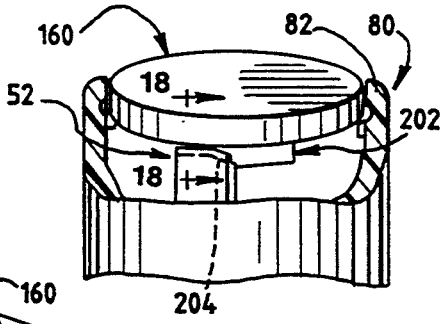
Fig. 16
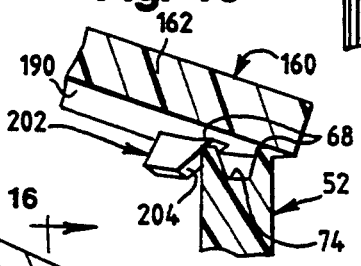
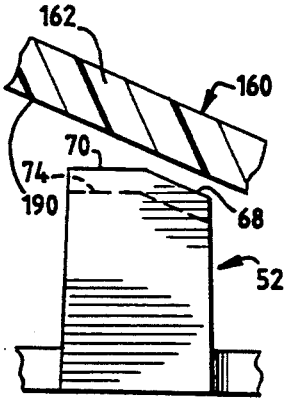
Fig. 14
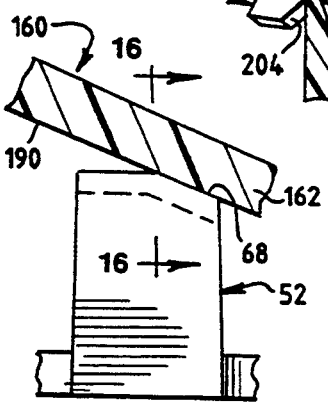
Fig. 15
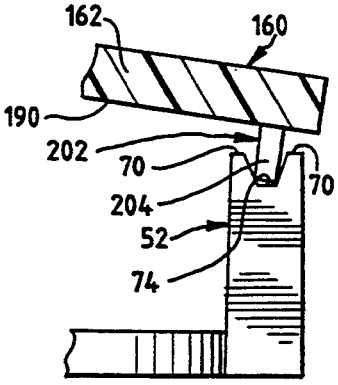
Fig. 18

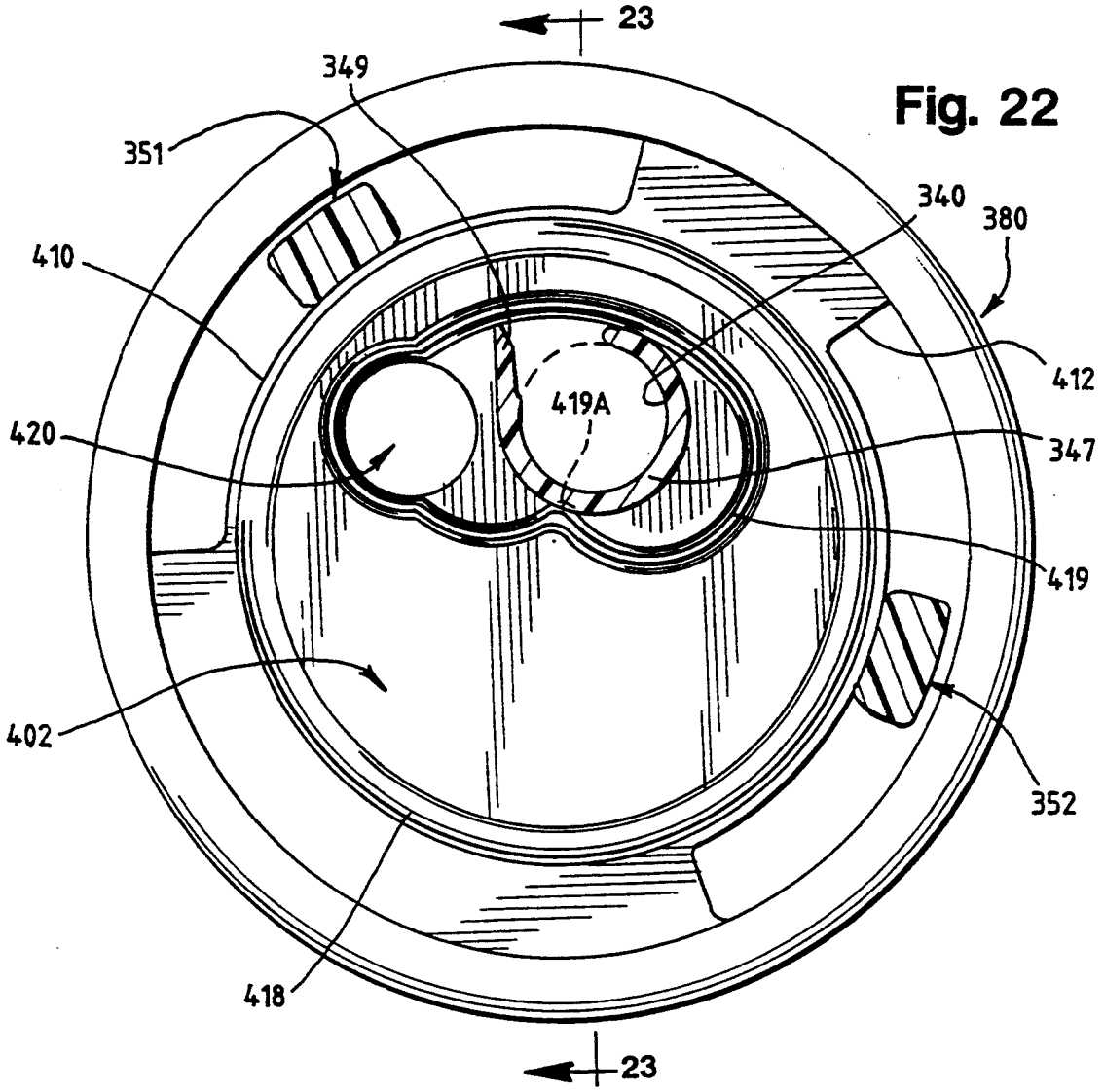
Fig. 22
Fig. 23
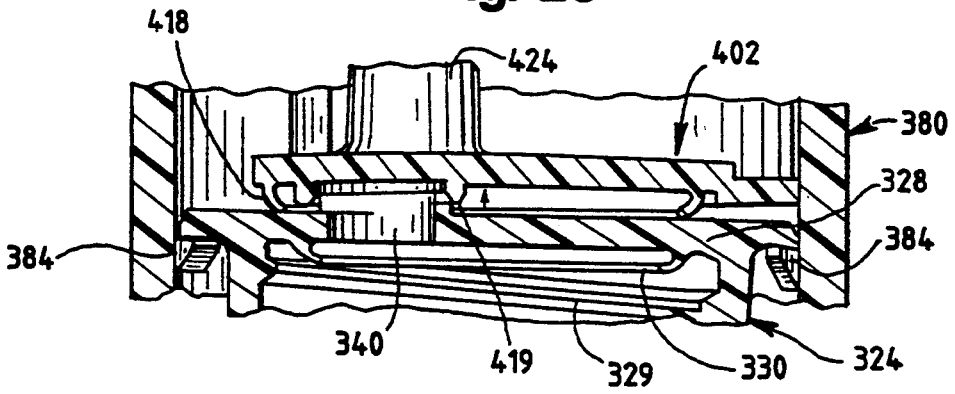

DISPENSING CLOSURE WITH A TWIST SLEEVE AND TWO INTERNAL PASSAGES

TECHNICAL FIELD

This invention relates to closures for containers, and more particularly to a dispensing closure which can be manipulated between a closed orientation and an open, dispensing orientation.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a toggle-action actuator, flip-up spout, or nozzle assembly for dispensing the container contents. See, for example, U.S. Pat. Nos. 5,058,775 4,962,869, 4,776,501, 4,645,086 and 3,516,581.

The toggle-action closures, such as those disclosed in the above-referenced U.S. Pat. Nos. 5,058,775, 4,962,869, and 4,776,501, require that the operator push down on a top, rear portion of the closure in order to pivot the actuator portion of the closure to the dispensing orientation.

On the other hand, U.S. Pat. No. 4,838,460 discloses a closure in which a tiltable actuator is mounted within a rotatable collar, and rotation of the collar operates through a cam ring to tilt the actuator between the closed and open positions.

While the above-discussed closures may function generally satisfactorily for the purposes for which they were designed, it would be desirable to provide an improved dispensing closure with structural and operational advantages.

In particular, it would be advantageous to provide a dispensing closure which operates by convenient means and does not require special operating instructions. To this end, such an improved dispensing closure should operate by means of a common manipulation which is well known to consumers and which is generally used by consumers to open containers.

Preferably, operation of such an improved closure should not require the operator to exert high forces and/or torque. A design requiring only a low force and/or torque would accommodate operation by physically disabled persons, such as arthritic persons.

During shipping, storage, and handling, a closure installed on a container may be inadvertently or accidentally subjected to external forces acting downwardly against the top of the closure. This can cause some types of closures cause to be moved to the open, dispensing position. This can result in spillage of the contents and/or damage of the container as a saleable item.

Accordingly, it would be desirable to provide an improved closure in which the likelihood of inadvertent, premature opening of the closure is eliminated or substantially reduced. Further, it would be beneficial if such an improved closure could operate to prevent inadvertent opening, while at the same time permitting deliberate opening, without damage to the closure.

Also, it would be advantageous if such an improved closure could be incorporated in a design having an aesthetically pleasing, "high style," exterior configuration substantially free of functional details and outwardly projecting features.

Further, it would be advantageous if the components of such an improved design could be relatively easily manufactured and readily assembled.

Finally, it would be desirable to provide an improved design which would accommodate the torque encountered either during application of the closure to a container in an automatic, high-speed, capping machine or during use of the closure by a person who may inadvertently or intentionally apply an unusually high torque to the closure.

The present invention provides an improved closure which can accommodate designs having the above-discussed benefits and features.

SUMMARY OF THE INVENTION

The present invention provides a novel dispensing closure which can have a contemporary, clean design with virtually all features contained within an aesthetically pleasing profile and with virtually no visible functional details or instructional nomenclature. Further, the closure does not open inadvertently when the closure top is subjected to impacts, and the closure components can be relatively easily manufactured and readily assembled.

The closure is adapted to be mounted over the opening in a container, especially a container of the type having a generally flexible wall portion which can be squeezed to assist in dispensing the contents from the container.

The closure includes a body for engaging the container over the opening. The body has an outlet passage for communicating with the container opening. In a preferred form, the body has a transverse end wall in which the outlet passage is defined. Also, in the preferred form, a pair of drive members or posts project upwardly from the body.

A sleeve is mounted on the body for rotation relative to the body about a rotation axis defined by the sleeve. The sleeve has a transverse deck over the body. The sleeve defines a discharge passage for communicating with the body outlet passage. In one form of the invention, the discharge passage is offset from the rotation axis so it can be moved in an arc relative to the body outlet passage when the sleeve is rotated.

According to one embodiment of the invention, a seal is located between the sleeve deck and the body transverse end wall, and the seal extends around the body outlet passage and the deck discharge passage.

In a preferred form of the invention, an actuator is mounted on the sleeve for rotation with the sleeve to occlude flow through the discharge passage from the container when the actuator means is in a closed, non-dispensing position and to permit flow through the discharge passage from the container when the actuator is tilted about a pivot axis to an open, dispensing position. An engaging means is defined by the body and the actuator for tilting the actuator between the closed position and the open position while the actuator is rotated with the sleeve.

According to a preferred embodiment, such an actuator is adapted to cooperate with the above-described embodiment of the closure body that includes upwardly projecting drive members. The drive members project through the sleeve. The actuator has engaging portions for engaging the drive members. The engagement between the body drive members and the actuator engaging portions effectively occurs on opposite sides of the pivot axis to effect tilting of the actuator.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 10 is a reduced, fragmentary, side elevational view taken generally along the plane 10—10 in FIG. 8 with portions of the sleeve cut away to illustrate interior detail;

FIG. 11 is a view similar to FIG. 10, but showing an intermediate position of the actuator between the full closed and full open positions;

FIG. 12 is a reduced, front elevational view taken generally along the plane 12—12 in FIG. 9 with portions of the sleeve cut away to illustrate interior detail;

FIG. 13 is a reduced, rear elevational view taken generally along the plane 13—13 in FIG. 8 with portions of the sleeve and actuator cut away to illustrate interior detail;

FIG. 14 is a greatly enlarged, fragmentary, cross-sectional view taken generally along the plane 14—14 in FIG. 13;

FIG. 15 is a view similar to FIG. 14 but showing a position of the components after the sleeve has been rotated through a small arc away from the full open orientation;

FIG. 16 is a fragmentary, cross-sectional view taken generally along the plane 16—16 in FIG. 15;

FIG. 17 is a view similar to FIG. 13, but showing a moved position of components wherein the sleeve has been rotated to a position intermediate the full closed and full open positions;

FIG. 18 is a greatly enlarged, fragmentary, cross-sectional view taken generally along the plane 18—18 in FIG. 17;

FIG. 22 is a view similar to FIG. 20, but showing the components in a moved, intermediate position;

FIG. 23 is a reduced, fragmentary, cross-sectional view taken generally along the plane 23—23 in FIG. 22;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

Figure 1:
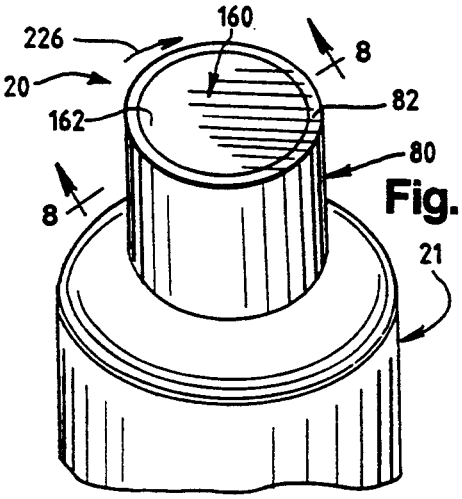
FIG. 1 is a perspective view of the closure of the present invention shown in a non-dispensing, closed orientation on a container.

FIG. 1 shows an embodiment of the dispensing closure of the present invention in the closed, non-dispensing position wherein the closure is represented generally by reference numeral 20. The closure 20 is adapted to be mounted on a container 21 which may have a conventional open mouth defined by a neck 22 (FIG. 3) or other suitable structure.

The closure 20 may be fabricated from a thermoplastic material, or other materials, compatible with the container contents. The container 21 is preferably a squeezable container having a flexible wall or walls which can be grasped by the user and compressed to increase the internal pressure within the container so as to squeeze the product out of the container. The container wall typically has sufficient, inherent resiliency so that when the squeezing forces are removed, the container wall returns to its normal, unstressed orientation.

The closure 20 includes a closure base or body 24 (FIGS. 3 and 4) for securement to the container 21. The body 24 includes a generally cylindrical, lower wall 27. A generally transverse closure wall or end wall 28 (FIGS. 3 and 4) extends across the body 24 over the upper end of the wall 27.

Figure 3:
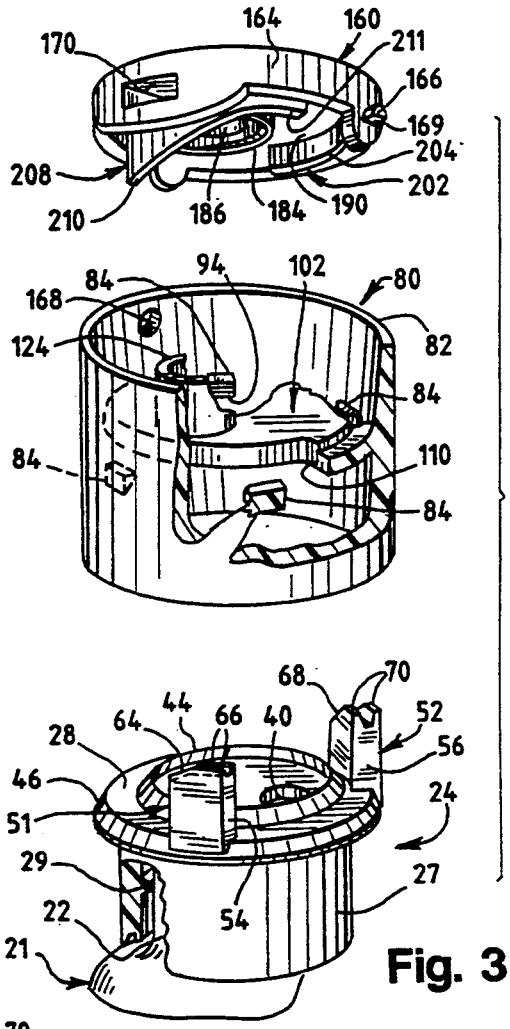
FIG. 3 is an enlarged, exploded, perspective view of the closure with portions of the structure cut away to illustrate interior detail.
Figure 4:
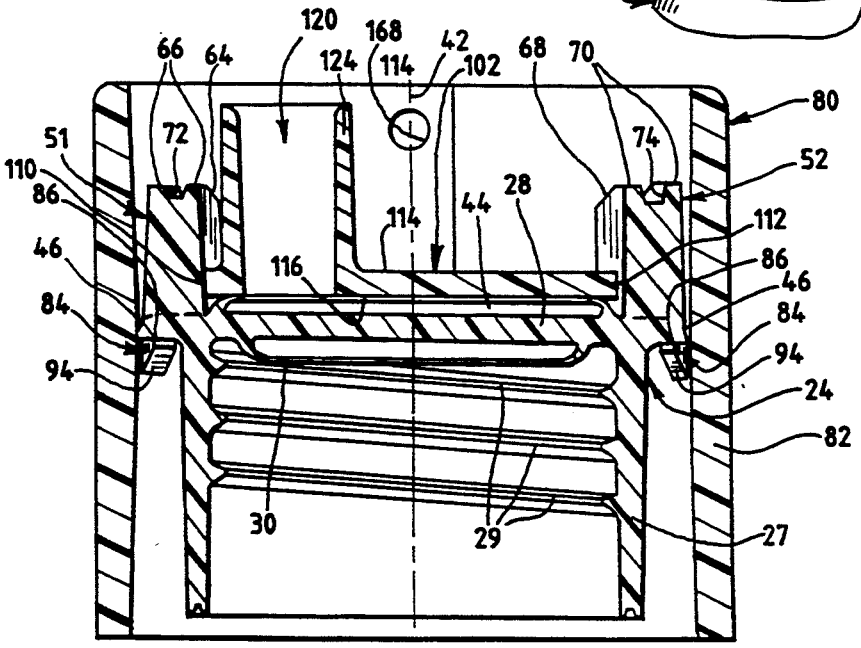
FIG. 4 is an enlarged, cross sectional view of the closure in the closed orientation with the actuator removed.

The lower, cylindrical wall 27 of the closure body 24 is adapted to engage the outer periphery of the top of the container neck 22 around the container mouth, as with threads 29 (FIGS. 3 and 4). Other suitable engaging means (e.g., snap-fit beads (not illustrated)) may be provided to secure the closure body 24 on the container. Alternatively, in some applications the closure body 24 could be non-releasably attached to, or formed unitary with, the container.

The closure body 24 includes a discharge aperture or passage 40 through the deck 28 as best illustrated in FIGS. 3, 5, 6, and 9. In the preferred embodiment, the discharge passage 40 is offset from a rotation axis 42 (FIG. 4) defined by the cylindrical configuration of the body lower wall 27.

An annular sealing ring 30 may be provided as shown in FIGS. 4 and 7–9 for engaging an interior edge of the container neck at the container mouth to effect a tight seal. The ring 30 is radially outward of the passage 40.

As illustrated in FIGS. 3–9, an upwardly projecting, flexible seal or sealing ring 44 protrudes upwardly from the body end wall 28. Preferably, the seal 44 is concentric with the cylindrical configuration of the body lower wall 27. Thus, the discharge passage 40 is axially offset relative to, but lies within, the seal 44.

Figure 5:
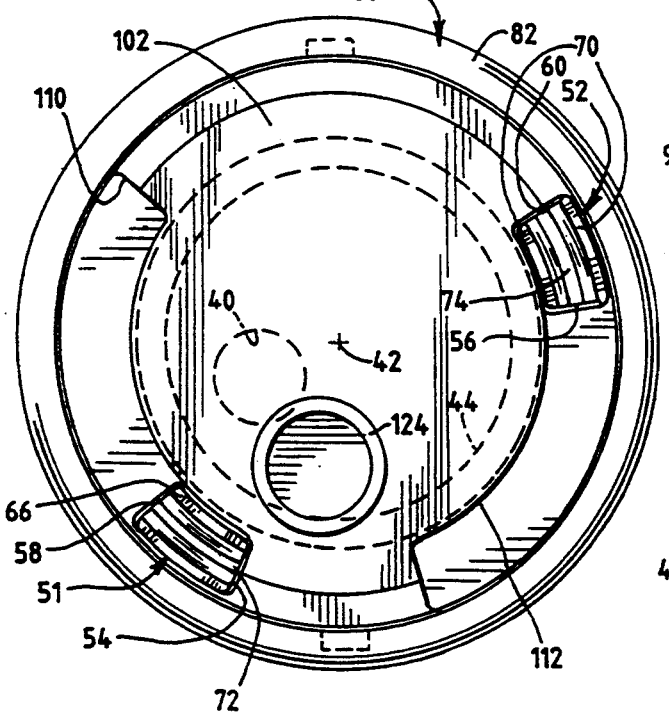
FIG. 5 is a plan view of the closure body and sleeve with the actuator removed as in FIG. 4.
Figure 7:
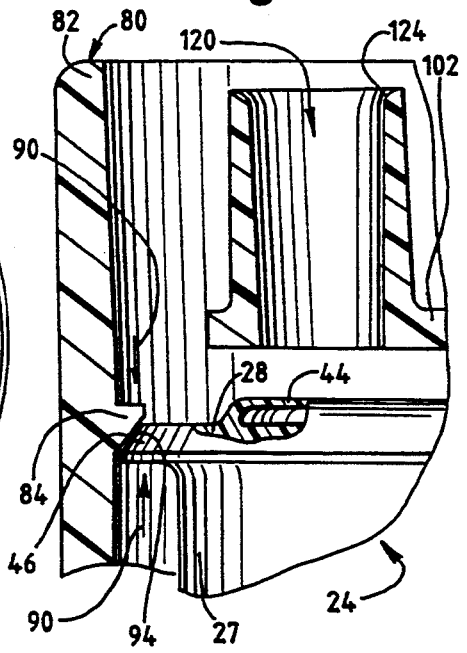
FIG. 7 is a greatly enlarged, fragmentary, partial cross-sectional view showing the closure body and sleeve being mounted together during an initial assembly operation.

Outwardly from the seal 44, the closure body end wall 28 defines a peripheral, chamfered or frustoconical cam surface 46 (FIGS. 3, 4 and 7). Further, a pair of drive members or posts 51 and 52 upwardly from the periphery of the body end wall 28. The drive members 51 and 52 are not located on a diameter of the end wall 28. In a preferred embodiment illustrated, the drive member 51 has a vertical side 54, and the drive member 52 has a vertical side 56. The arc angle between the two sides 54 and 56 is about 123°. The widths of the drive members 51 and 52 is the same, and in terms of an arc angle, the width is about 25°. As illustrated in FIG. 5, the drive member 51 has a second, vertical side surface 58, and the drive member 52 has a second, vertical side surface 60. The arc angle between the surfaces 58 and 60 is about 187°.

As illustrated in FIG. 3, the top end of the drive member 51 has a surface 64 inclined relative to a plane that is normal to the rotational axis 42 (FIG. 4) and has an abutment surface 66 which is oriented parallel to the plane. Similarly, the drive member 52 has a surface 68 which is inclined relative to a plane that is normal to the rotational axis 42 (FIG. 4) and has an abutment surface 70 which is oriented parallel to the plane. Further, the top end of the drive member 51 defines a groove or channel 72, and the top end of the drive member 52 defines a groove or channel 74. The drive members 51 and 52 function to open and close the closure 20 as explained in detail hereinafter.

The closure base or body 24 is adapted to receive a ring or twist sleeve 80, as illustrated in FIGS. 1–13 and 17, so as to accommodate rotation of the sleeve 80 relative to the body 24. To this end, the sleeve 80 includes a generally annular wall 82 in which the body 24 is received. As illustrated in FIG. 3, the sleeve 80 includes four, spaced-apart retention members 84 which each project inwardly from the inner surface of the sleeve side wall 82. Each retention member has an upwardly facing support surface 86 for engaging the bottom of the peripheral portion of the body end wall 28 as shown in FIG. 4.

The sleeve 82 and the body 24 are easily assembled as shown in FIG. 7 by effecting a relative axial displacement as indicated by the arrows 90. The assembly is facilitated by a chamfered or angled surface 94 (FIG. 7) on each retention member 84. The angled surfaces 94 of the retention members 84 engage the frustoconical surface 46 of the closure body end wall 28 as the sleeve 80 and body 24 are moved into engagement. When opposed, axial forces of sufficient magnitude are applied to the sleeve 80 and body 24 there is sufficient temporary deflection or deformation of one or both of the components in the radial direction so that the body end wall 28 slides past the retention members 84 and becomes lodged on top of the retention members 84.

As illustrated in FIG. 4, the sleeve 80 includes a transverse deck 102 for engaging the closure body end wall 28 so as to prevent downwardly movement of the sleeve 80 while the sleeve retaining members 84 prevent upward movement of the sleeve 80. The deck 102 defines two spaced-apart slots 110 and 112 (FIGS. 5 and 6) for receiving the upwardly projecting members 51 and 52, respectively.

As illustrated in FIG. 4, the sleeve deck 102 has a generally planar, upwardly facing top surface 114 and has a generally planar, downwardly facing bottom surface 116. When the sleeve 80 is properly assembled on the body 24 as illustrated in FIG. 4, the sleeve deck bottom surface 116 compresses, and sealingly engages, the body end wall sealing ring 44.

The sleeve deck 102 also defines a discharge passage 120 which extends through the deck. In the preferred embodiment illustrated in FIG. 4, the sleeve 80 includes a discharge spout or tube 124 which projects upwardly from the deck 102, and the discharge aperture 120 is defined within, and through the tube 124. Further, in the preferred embodiment illustrated in FIG. 4, the tube 124 has a generally hollow, cylindrical or annular configuration, and the discharge passage 120 defined by the tube 124 is offset from the rotation axis 42 of the closure. Thus, when the sleeve 80 is rotated about the axis 42 relative to the closure body 24, the discharge passage 120 is moved in an arc relative to the closure outlet passage 40.

Figure 6:
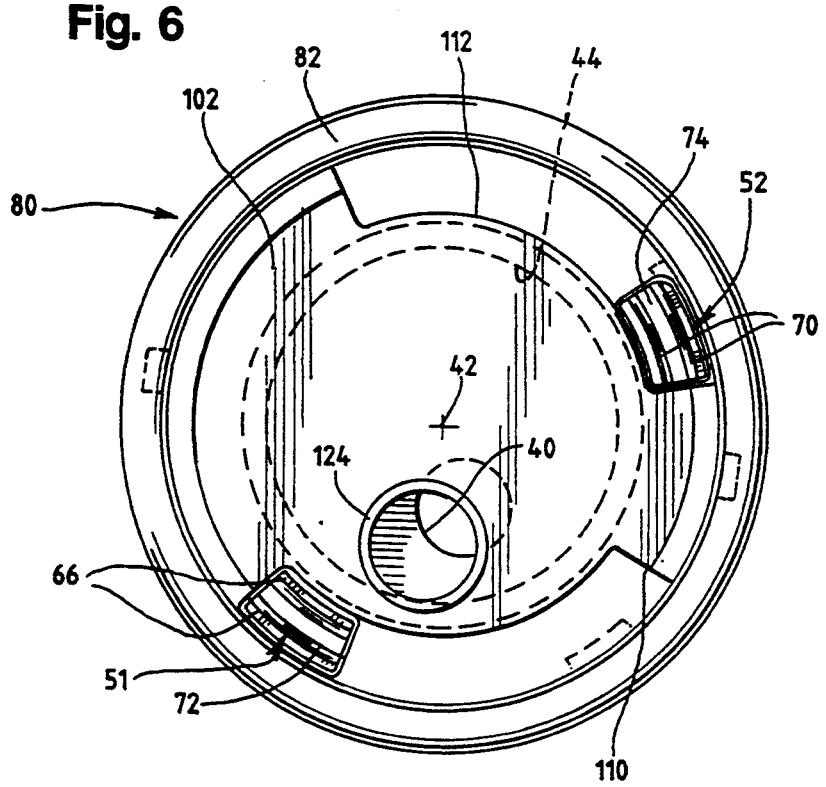
FIG. 6 is a view similar to FIG. 5, but showing the sleeve rotated to place the closure body and sleeve in an open, dispensing orientation.

The sleeve 80 can be rotated from the position illustrated in FIG. 5, which corresponds to a closed position, to the position illustrated in FIG. 6, which corresponds to an open position. In the closed position, the drive member 51 engages one end of the sleeve slot 110 while the drive member 52 engages one end of the sleeve slot 112. On the other hand, when the sleeve 80 is rotated to the open position illustrated in FIG. 6, the drive members 51 and 52 engage the other ends of the slots 110 and 112, respectively.

When the sleeve 80 is in the closed position illustrated in FIG. 5, the discharge tube 124 is not aligned with the body outlet passage 40, but the discharge tube 124 and outlet passage 40 are both within the body seal ring 44. On the other hand, when the sleeve 80 is moved to the position illustrated in FIG. 6 corresponding to the closure open configuration, then the sleeve discharge passage 124 is partially aligned with the body outlet passage 40.

As illustrated in FIGS. 1–3, 8 and 9, the sleeve 80 receives a generally disc-like nozzle assembly, actuator means, or actuator 160. The actuator 160 is mounted on the sleeve 80 for rotation with the sleeve about the axis 42 (FIG. 4). The actuator 160 includes a transverse top wall 162 and a peripheral flange 164 (FIGS. 1, 2, 8 and 9). At each of two diametrically opposed portions of the flange 164 there is a protuberance or pivot member 166 (one being visible in FIG. 3).

The pivot members 166 cooperate with the sleeve 80 to mount the actuator 160 for pivoting movement within the sleeve. To this end, the inner surface of the sleeve wall 82 defines two recesses 168 (FIGS. 1 and 4) for each mating with one of the pivot members 166 to provide a snap-action engagement of the pivot member 166. This accommodates the pivoting movement of the actuator 160 about a pivot axis defined by the pivot members 166 and receiving recesses 168.

Figure 2:
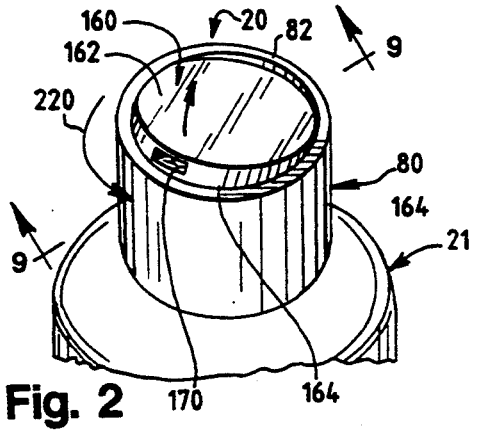
FIG. 2 is a perspective view of the closure shown in an open, dispensing orientation.

The bottom edge of each pivot member 166 is preferably provided with a chamfer 169 for facilitating assembly. When the sleeve 80 and actuator 160 are assembled, the actuator pivot members 166 and body recesses 168 function as mounting means so that the actuator 160 can be pivoted (by means described in detail hereinafter) until the forward end is exposed above the sleeve 80 as illustrated in FIGS. 2 and 9.

Figure 8:
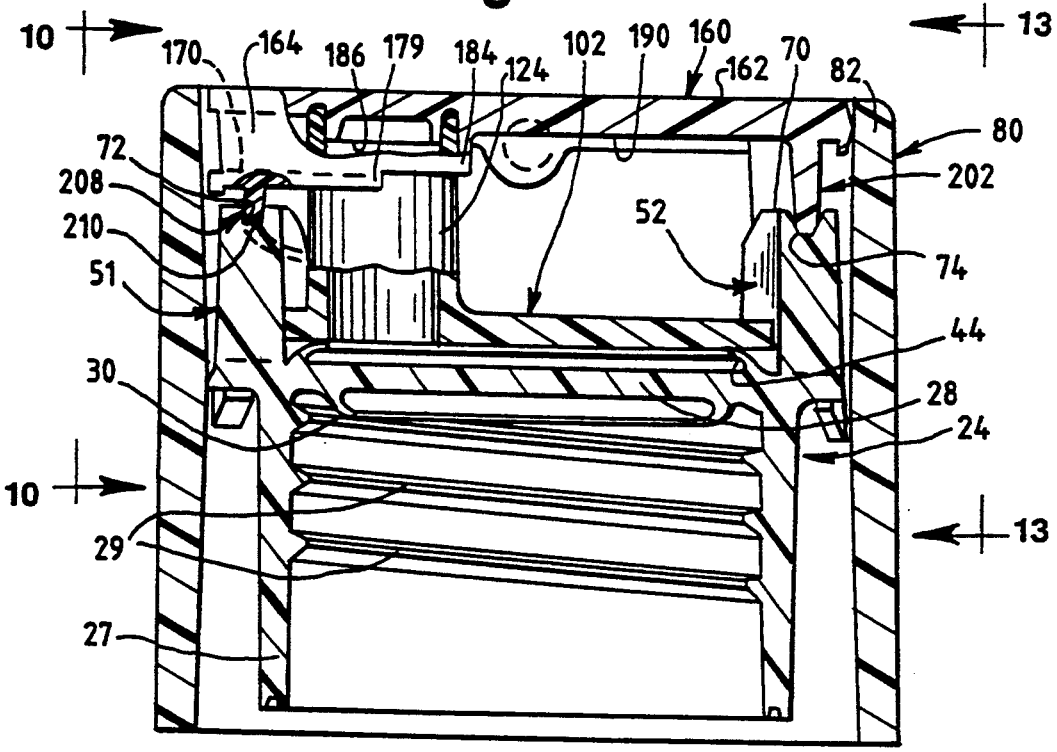
FIG. 8 is a greatly enlarged, partial cross-sectional view taken generally along the plane 8—8 in FIG. 1.

The actuator 160 includes a structure on the bottom surface of the top wall 162 which functions—depending upon the orientation of the actuator 160—to either permit dispensing of flowable material from the body discharge tube 124 or occlude the tube passage 120 so as to prevent flow out of the discharge tube 124. In particular, as shown in FIGS. 3, 8 and 9, the actuator 160 includes a forwardly extending nozzle or channel 170 which merges with, and opens into, a stepped, cylindrical sealing wall 179. The wall 179 surrounds and seals the upper periphery of the discharge tube 124 when the actuator 160 is in the closed position as illustrated in FIG. 8. In particular, the wall 179 forms a seal around the outer periphery of the discharge tube 124 as indicated at the front of the tube 124 by reference number 180 (FIG. 9) and as indicated by the reference numeral 184 at the rear of the tube 124.

Preferably, a sealing plug 186 projects downwardly from the bottom of the actuator top wall 162. The sealing plug 186 has a generally cylindrical or annular configuration and is adapted to enter into the opening at the top of the discharge tube 124 to sealingly occlude the discharge aperture 120 in the tube 124 when the actuator is in the closed position as illustrated in FIG. 8.

Figure 9:
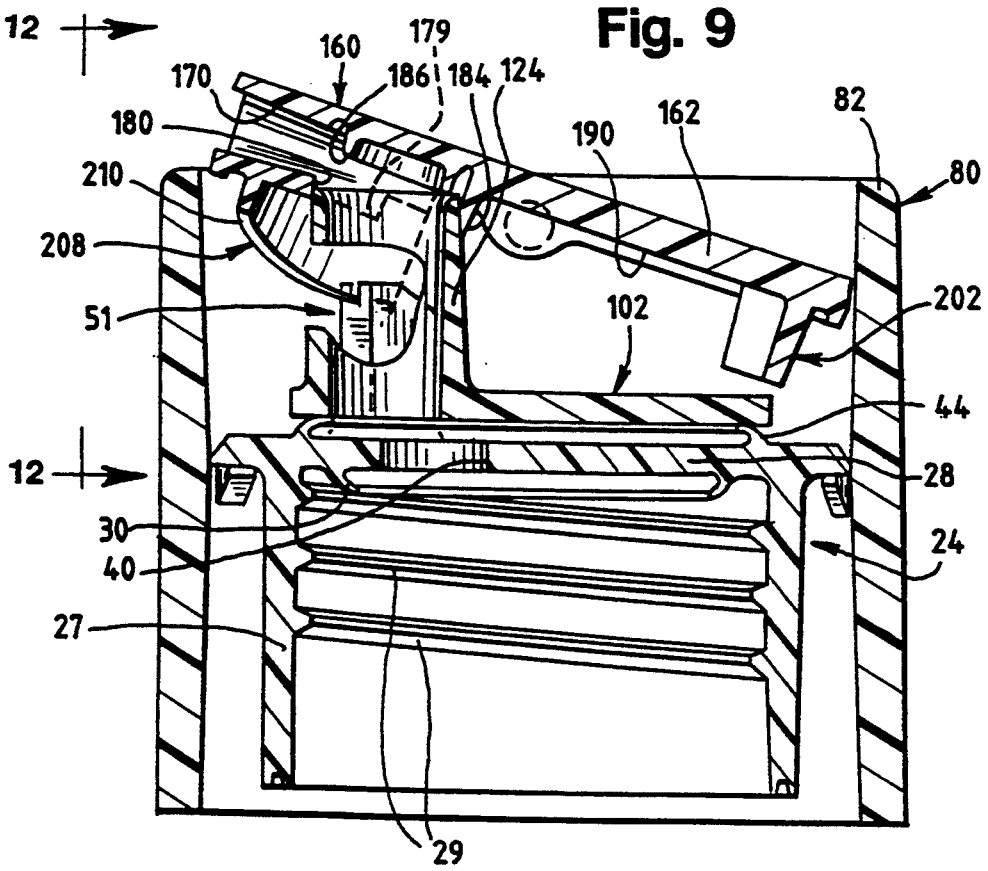
FIG. 9 is a greatly enlarged, partial cross-sectional view taken generally along the plane 9—9 in FIG. 2.

On the other hand, when the actuator 160 is tilted to the dispensing position as illustrated in FIG. 9 (by means described in detail hereinafter), then the front portion of the sealing plug 186 is tilted away from the top of the discharge tube 124 to permit flow of the material out of the discharge aperture in the tube 124 and through the dispensing nozzle 170. When the actuator 160 is tilted to the dispensing position as illustrated in FIG. 9, the wall 179 still continues to seal the outer periphery of the upper end of the discharge tube 124 so that the container contents, while being dispensed into the nozzle 170, cannot leak out around the top of the discharge tube 124.

The actuator 160 includes a novel structure for cooperating with the body drive members 51 and 52 to open and close the closure 20 when the sleeve 80 is rotated. Specifically, the actuator wall 162 defines a downwardly facing engaging surface 190 (FIGS. 3, 8, 9, 12, 14–16 and 18). The surface 190 is adapted to be engaged by the drive member 52 when the actuator 160 is pivoted beyond a certain point toward the open position, and a rear cam rail 202 projects downwardly from the surface 190 for engaging the drive member 52 when the orientation of the actuator 160 is in the range between the full closed position and a partially open position. The rear cam rail 202 defines an angular, partially helical cam ramp 204 (FIGS. 3, 13, 16 and 17). When the actuator 160 is closed, the cam ramp 204 is inclined relative to a plane that is normal to the rotational axis (axis 42 in FIG. 4).

At the front of the actuator 160 there is a downwardly projecting front cam rail 208 (FIGS. 3 and 8–12). The front cam rail 208 has a downwardly angled cam ramp 210 and a short, flat surface 211. When the actuator 160 is closed, the ramp 210 is inclined relative to a plane that is normal to the rotational axis (axis 42 in FIG. 4), and the flat surface 211 is perpendicular to the axis 42. Preferably, the front cam rail 210 is partially helical and has an inclination which is slightly less steep than the inclination of the rear cam rail cam ramp 204.

When the actuator 160 is in the closed position as illustrated in FIG. 8, the front cam rail 208 is received within the channel 72 at the top of the first drive member 51, and the rear cam rail 202 is received within the channel 74 at the top of the rear drive member 52. When a consumer wishes to open the closure, the container 21 is grasped in one hand and the closure sleeve 80 is grasped in the other hand. Relative rotation is effected between the container 21 and the sleeve 80. Typically, the user would hold the container 21 relatively stationary while the sleeve 80 is rotated on the container 21. Because the closure body 24 is threadingly engaged tightly with the container 21, the body 24 and container 21 remain stationary while the sleeve 80 is rotated in the direction of the arrow 220 illustrated in FIG. 2. This is the conventional, unscrewing direction for a conventional right-hand thread, and most consumers would readily understand from everyday experience that the unscrewing direction 220 is counterclockwise when looking downwardly on the top of the closure 20.

As the sleeve 80 is rotated in the counterclockwise direction as indicated by the arrow 220 in FIG. 2, the actuator 160 is rotated with the sleeve 80 relative to the drive members 51 and 52 which project upwardly from the closure body 24 and are stationary. Rotation of the sleeve 80 causes the actuator front cam rail ramp 210 to engage the drive member 51 and tilt the front of the actuator 160 upwardly. At the same time, the rear cam rail cam ramp 204 moves in the rear drive member 52 to accommodate the downward tilting motion of the rear portion of the actuator 160. Also, because the rear cam ramp 204 is steeper than the front cam ramp 210, there is no danger of the rear cam ramp 204 initially engaging and binding on the rear drive member 52 as the actuator 160 pivots open. The rear cam rail 202 has a relatively short length, and the rear cam rail 202 becomes completely separated from the rear drive member 52 as the actuator 160 is tilted to the full open position (FIG. 13).

When the actuator 160 is in the full open position, the container contents can be dispensed through the body outlet passage 40 and sleeve discharge tube 124 as shown in FIGS. 6 and 9. In the full open position, the top of the rear drive member 52 is spaced somewhat below the actuator top wall bottom surface 190 as illustrated in FIG. 14.

In order to close the actuator 160, the sleeve 80 is rotated in the clockwise direction as viewed from the top (i.e., in the direction indicated by the arrow 226 in FIG. 1). The actuator 160 rotates with the sleeve 80 so as to move the actuator cam rails 202 and 208 relative to the drive members 52 and 51, respectively. Thus, the front cam rail 208 moves away from the front drive member 51, but the rear cam rail 202 moves toward the rear drive member 52. However, as illustrated in FIG. 15, initially the actuator top wall bottom surface 190 contacts the edge of the angled surface 68 of the rear drive member 52 (FIGS. 15 and 16). As the sleeve 80 is further rotated, the rear portion of the actuator 160 is forced upwardly to pivot the actuator toward the closed position. Further rotation of the sleeve 80 brings the rear cam rail 202 into engagement with the rear drive member 52 as illustrated in FIGS. 17 and 18. The cam ramp 204 of the rear cam rail 202 then engages the bottom of the groove 74 in the top of the rear drive member 52 to pivot the actuator 160 to the fully closed position. In the fully closed position, the front cam rail surface 211 is located over the front drive member 51 as can be seen in FIG. 10.

Regardless of the orientation of the actuator 160, the novel sealing system prevents leakage of the container contents between the sleeve deck 102 and closure body 24. In particular, with reference to FIGS. 8 and 9, the seal ring 44 on the closure body 24 at all times seals around the periphery of the closure body outlet passage 40 and sleeve discharge tube 124. The container product can be forced out through the discharge passage 120 of the discharge tube 124 only when the actuator 160 is moved away from the fully closed position, and the seal ring 44 always prevents leakage from between the sleeve deck 102 and closure body end wall 28.

A second embodiment of the closure of the present invention is illustrated in FIGS. 19–25 wherein the closure is designated generally by the reference number 320. The closure 320 is adapted to be mounted on a container (not illustrated) such as the container 21 described above with reference to FIGS. 1 and 2.

The closure includes a closure base or body 324 having a cylindrical lower wall 327 with internal threads 329 for engaging mating threads on the container neck. Other suitable engaging means (e.g., snap-fit beads) may be provided to secure the closure body 324 on the container. Alternatively, in some applications the closure body 324 could be non-reasonably attached to, or formed unitary with, the container.

Figure 21:
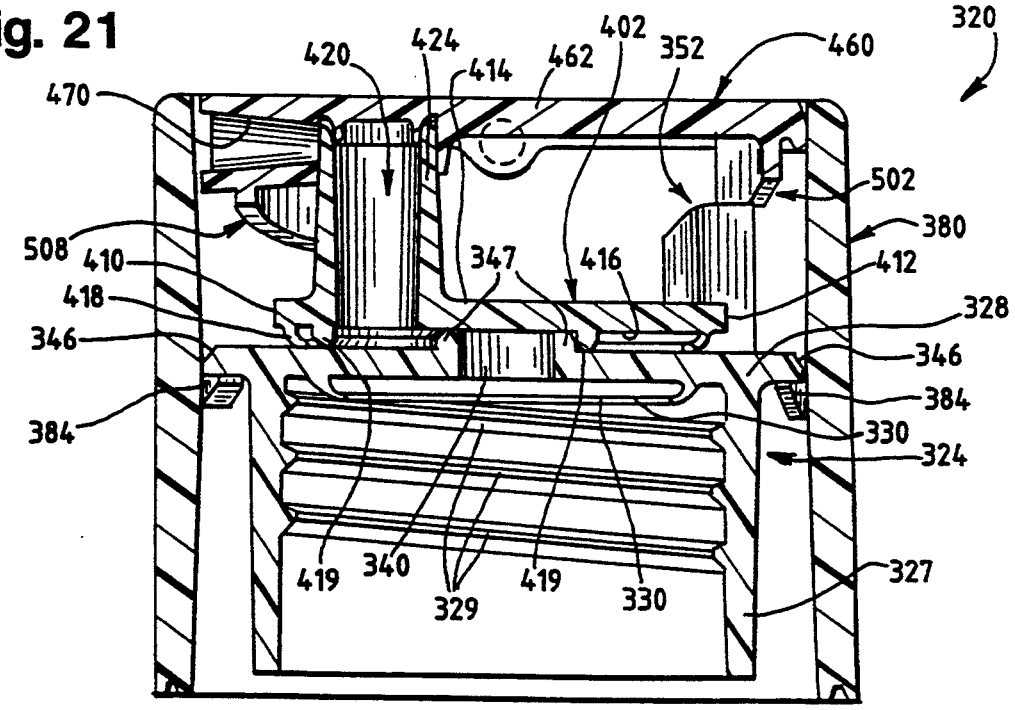
FIG. 21 is a reduced, cross-sectional view taken generally along the planes 21—21 in FIG. 20.

An annular sealing ring 330 may be provided as shown in FIG. 21 for engaging an interior edge of the container neck at the container mouth to effect a tight seal.

The closure body 324 includes a transverse end wall 328 defining an outlet passage 340 and a peripheral, frustoconical surface 346. The outlet passage 340 is radially offset from a central axis 342 defined by the frustoconical surface 346 and cylindrical wall 327. Projecting upwardly from the body end wall 328 is a seal or bead 347 which extends partially around the outlet passage 340 and which has a straight portion 349 (FIG. 20) extending tangentially from the outlet passage 340. The outer, upper edge of the sealing bead 347 and extension 349 is chamfered.

The closure body 324 also has a front drive member or post 351 and a rear drive member or post 352 which each project upwardly from the periphery of the end wall 328 at the frustoconical surface 346. Preferably, as with the drive members 51 and 52 described above with reference to the first embodiment illustrated in FIGS. 1–18, the drive members 351 and 352 do not lie on a common diameter. Thus, the shortest circular arc between the nearest sides of the drive members 351 and 352 is less than 180°.

Figure 19:
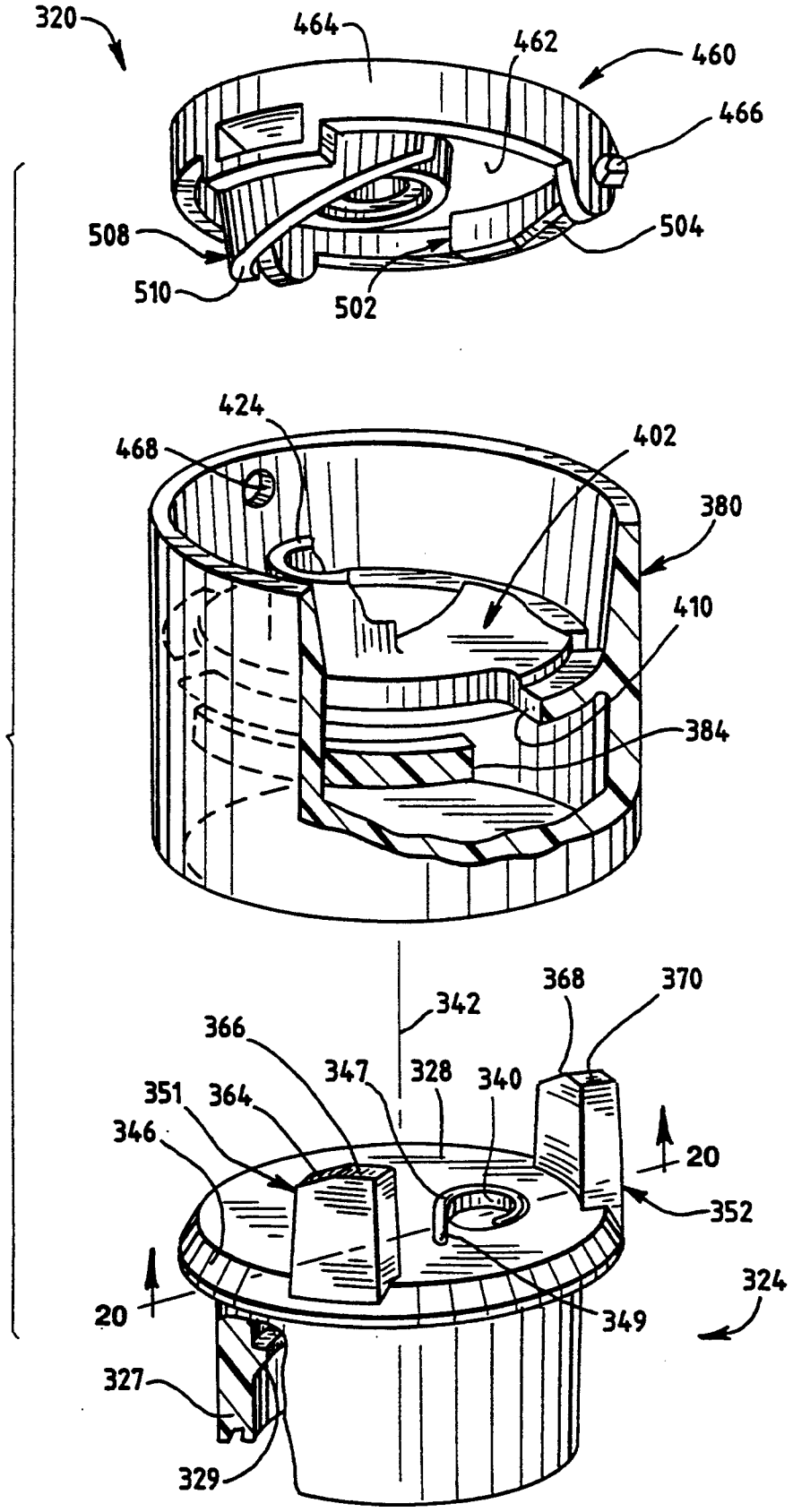
FIG. 19 is an exploded, perspective view of another embodiment of the closure with portions of the structure cut away to reveal interior detail.

As shown in FIG. 19, the top of the front drive member 351 has a drive surface 364 which is inclined relative to a plane normal to the rotational axis 342 and has an abutment surface 366 which is oriented parallel to that plane. Similarly, the rear drive member 352 has a drive surface 368 inclined relative to a plane that is normal to the rotational axis 342 and has an abutment surface 370 which is oriented parallel to the plane.

The closure body 324 is adapted to receive a sleeve 380 mounted thereon as illustrated in FIG. 21. To this end, the sleeve 380 includes a plurality of inwardly projecting retainer members 384 which are adapted to slidably engage the frustoconical surface 346 of the closure body 324 as the sleeve 380 is pushed onto the closure body 324. The parts are sufficiently resilient to accommodate a temporary, radial deformation so that the retainer members 384 slip below the peripheral edge of the closure body end wall 328.

The sleeve 380 has a transverse deck 402 which defines a pair of spaced-apart peripheral slots 410 and 412 (FIG. 20) for receiving the drive members 351 and 352, respectively.

The deck 402 has an upwardly facing surface 414 and a downwardly facing surface 416. Projecting downwardly from the surface 416 is an annular, compressible, seal ring 418. The seal ring 418 sealingly engages the upper surface of the closure body deck 328.

Also projecting downwardly from the sleeve deck lower surface 416 is an inner, irregularly shaped seal or bead 419. The seal 419 lies within the annular seal ring 418 and is adapted to receive the seal beads 347 and 349 projecting upwardly from the closure body end wall 328 around the outlet passage 340.

The sleeve seal bead 419 defines an enclosed area and has a first cusp 419A, a second cusp 419B, and a third cusp 419C. As illustrated in FIG. 21, the inner and outer edges of the seal bead 419 are chamfered.

The sleeve deck 402 defines a discharge passage 420 for communicating with the body outlet passage 340. As illustrated in FIG. 21, the discharge passage is defined within a discharge tube 424, and the bottom of the discharge passage 420 is defined in part by the downwardly projecting seal bead 419 between the second cusp 419B and third cusp 419C.

The sleeve 380 receives a generally disc-like nozzle assembly, actuator means, or actuator 460 (FIG. 19). The actuator 460 is mounted on the sleeve 380 for rotation with the sleeve 380 about the axis 342 (FIG. 19). The actuator 460 includes a transverse top wall 462 and a peripheral flange 464. At each of two diametrically opposed portions of the flange 464 there is a protuberance or pivot member 466. The pivot members 466 cooperate with the sleeve 380 to mount the actuator 460 for pivoting movement within the sleeve 380. To this end, the inner surface of the sleeve 380 defines two recesses 468 (one recess 468 being visible on the far side in FIG. 19). Each recess 468 mates with one of the pivot members 466 to provide a snap-action engagement of the pivot member 466. This accommodates the pivoting movement of the actuator 460 about the body pivot axis defined by the pivot members 466 and receiving recesses 468.

The actuator 460 is substantially identical to the actuator 160 described above with reference to the first embodiment illustrated in FIGS. 1–18. To this end, the actuator is adapted to be tilted between a closed position (FIG. 21) and an open position (similar to the open position shown for the first embodiment actuator 160 illustrated in FIG. 9).

The actuator 460 includes a channel or nozzle 470 for communicating with the upper end of the sleeve discharge tube 424 when the actuator is in the tilted, open position. When the actuator 460 is closed as illustrated in FIG. 21, the upper end of the discharge tube 424 is sealed closed in the same manner as described above with respect to the first embodiment tube 124 illustrated in FIGS. 1–18.

The actuator 460 includes a novel structure for cooperating with the body drive members 351 and 352 to open and close the closure 320 when the sleeve 380 is rotated. Specifically, as illustrated in FIG. 19, the actuator 460 includes a front cam rail 508 having a downwardly facing, angled cam surface 510 for engaging the upwardly facing surfaces 364 and 366 of the first drive member 351.

The actuator 460 includes a downwardly projecting, rear cam rail 502 having a downwardly angled cam surface 504 for engaging the upwardly facing surfaces 368 and 370 of the rear drive member 352.

When the sleeve 380 is rotated, the actuator 460 is carried with the sleeve to move the cam rails 502 and 508 relative to the drive members 351 and 352, respectively. The actuator 460 and drive members 351 and 352 function in substantially the same way as the first embodiment actuator 160 and drive members 51 and 52 described above with reference to FIGS. 1–18.

Figure 20:
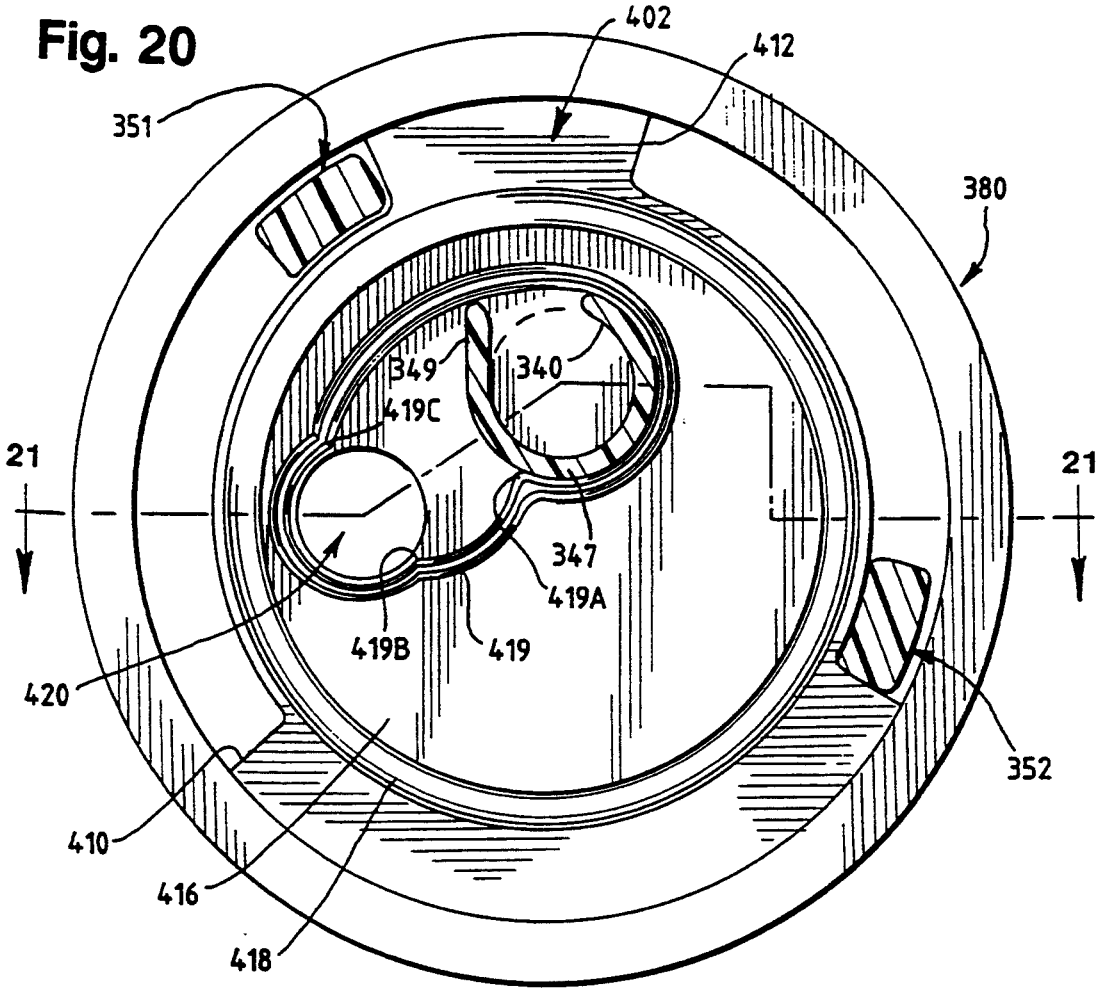
FIG. 20 is a greatly enlarged, cross-sectional view taken generally along the plane 20—20 in FIG. 19, but with the sleeve and actuator mounted to the body.

The second embodiment illustrated in FIGS. 19–25 has unique sealing capabilities. When the actuator 460 is fully closed as illustrated in FIGS. 20 and 21, the sleeve seal 419 is positioned to engage the closure body seal 347 and 349 so that the discharge passage 420 is spaced from, and sealed from, the closure body outlet passage 340. In particular, as can be seen in FIG. 20, when the closure is closed, the closure body seal 347 and extension 349 sealingly engage the sleeve seal 419 and sleeve deck lower surface 416 to prevent fluid communication between the closure body outlet passage 340 and the sleeve discharge passage 420. This is effective to prevent leakage into the discharge tube 420 during overpressure conditions, such as might occur during shipping or handling (e.g., from impacts on the container or temperature increases).

When the sleeve 380 is rotated to open the actuator 460, the sleeve deck 402 rotates as illustrated in FIGS. 22 and 23 to move the discharge passage 420 and seal bead 419 relative to the closure body outlet passage 340. As the seal bead cusp 419A moves pass closure body seal bead 347, there is interference which causes the sleeve seal 419 and closure body seal bead 347 to slide axially on the chamfered edges. This deflects the sleeve deck 402 a small amount upwardly away from the closure body end wall 328 as illustrated in FIG. 23. An increased amount of torque is required to effect this deformation, and this provides a resistance to rotation of the sleeve. This tends to oppose movement of the closure components away from the fully closed position.

Figure 24:
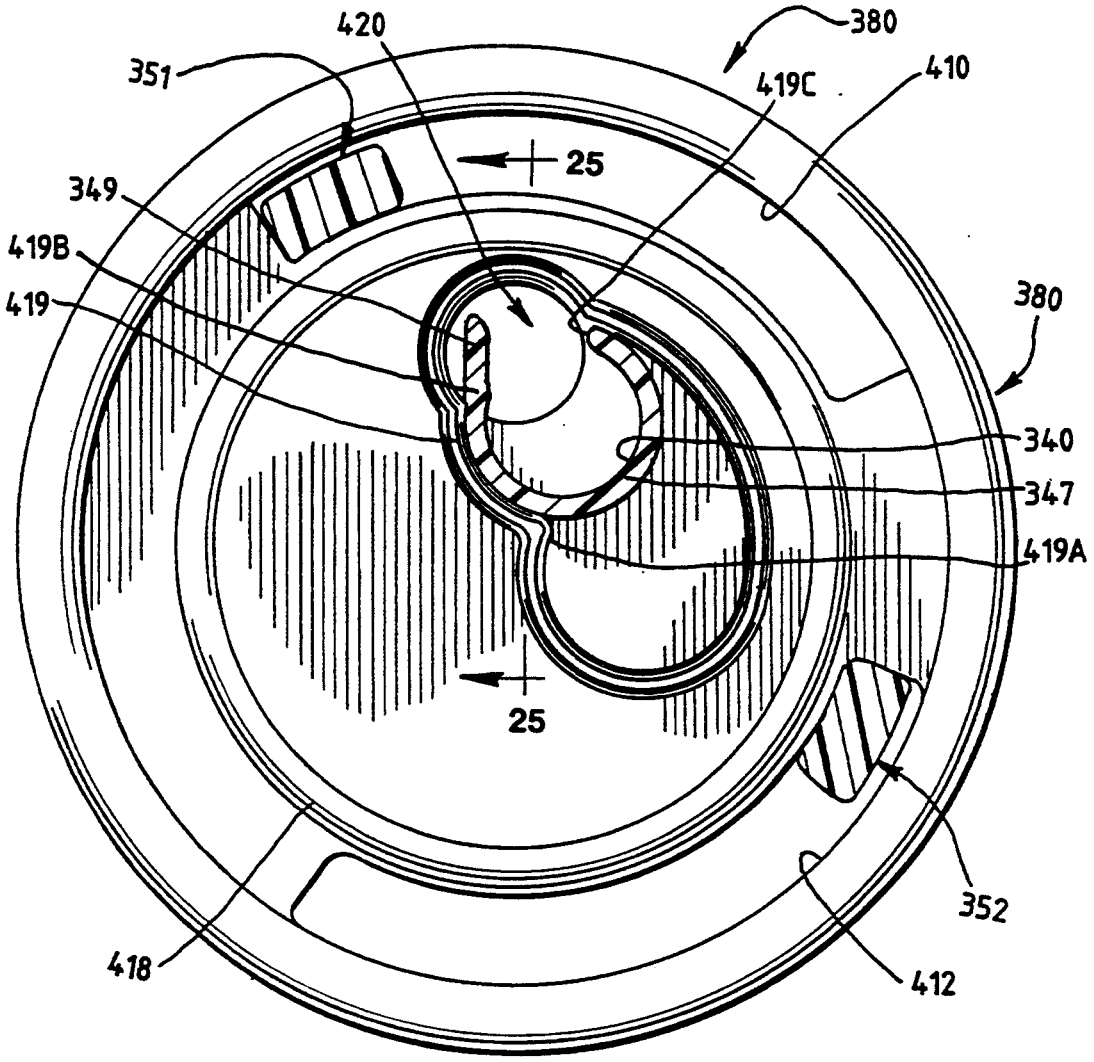
FIG. 24 is a view similar to FIG. 23, but showing the components in a moved position corresponding to the full open condition of the closure.
Figure 25:
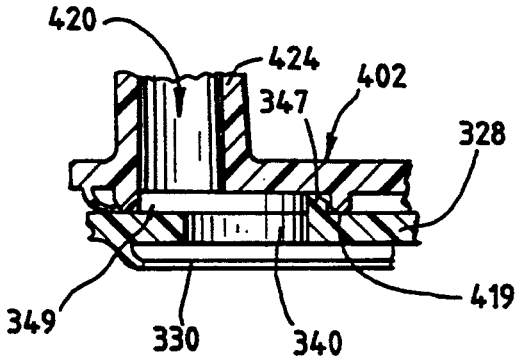
FIG. 25 is a reduced, fragmentary, cross-sectional view taken generally along the plane 25—25 in FIG. 24.

However, if sufficient torque is exerted on the sleeve 380, the components are sufficiently deformed to accommodate the movement of the sleeve seal bead 419 to the open position as illustrated in FIGS. 24 and 25. In the open position, the closure body seal bead 347 is seated on the other side of the cusp 419A and is retained in the open position by the cooperating configuration of the cusps 419A, 419B and 419C. In the open position, a portion of the sleeve discharge passage 420 overlies a portion of the closure body outlet passage 340. This establishes communication between the container interior and the discharge tube 424. Of course, in the open position, the actuator 460 is tilted away from the top of the discharge tube 424 (in a manner analogous to the orientation of the first embodiment actuator 160 illustrated in FIG. 9), and the container contents can be dispensed through the closure.

When the sleeve 380 is rotated through the intermediate position between the full closed and full open positions as illustrated in FIGS. 22 and 23, the slight outward displacement of the center of the sleeve deck 402 will break the seal between the sleeve seal bead 419 and the top surface of the body end wall 328. However, the potential for leakage at that point is of little concern because the container is typically not being squeezed to discharge the contents at that time and because the momentary interruption in sealing of the bead 419 against the body end wall 328 is very brief. Further, the annular, resilient seal 418 completely surrounds the seal bead 419 and prevents any leakage radially outwardly of the seal ring 418.

In each of the two embodiments of the closure illustrated in FIGS. 1–25, it will be appreciated that the body outlet passage (40 or 340) is not fully aligned with the sleeve deck discharge passage (120 or 420). However, in other, alternate designs, alignment of the two passages in the full open condition may be desired and could be effected by appropriate placement of the outlet passage and discharge passage in the body and sleeve, respectively.

Further, snap-fit engagement structures may be provided at the full closed position and the full open position for providing a tactile sensation to the user when the full open and full closed positions have been reached.

Figure 26:
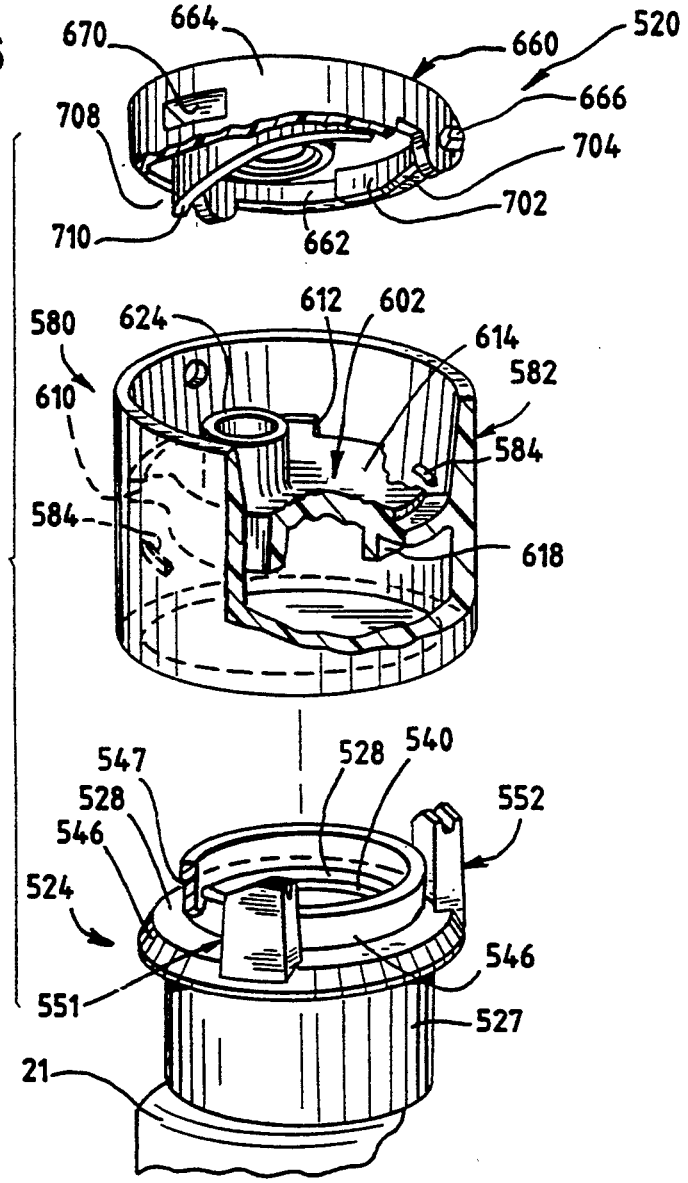
FIG. 26 is an exploded, perspective, fragmentary view of another embodiment of the closure with portions of the structure cut away to reveal interior detail.
Figure 27:
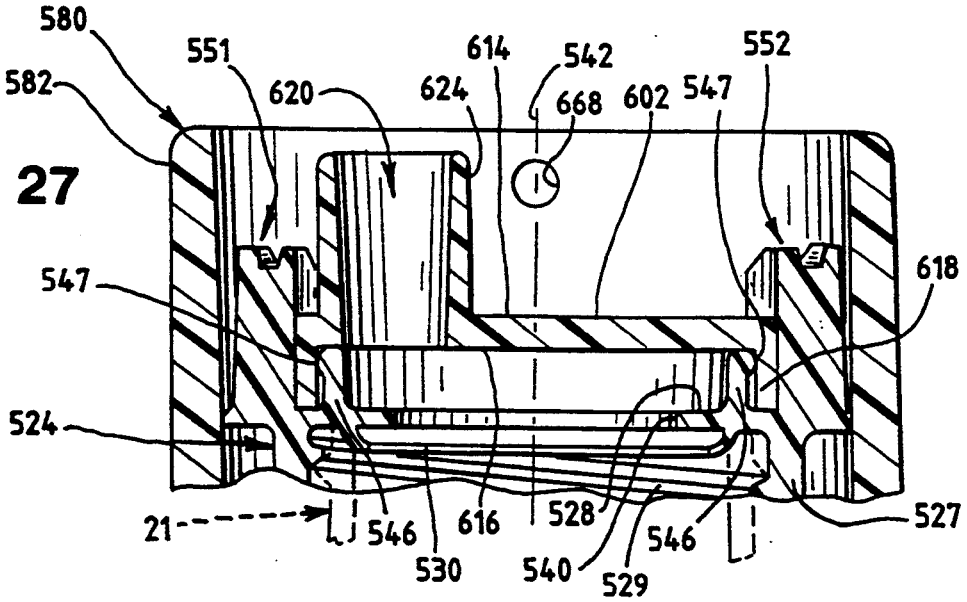
FIG. 27 is a greatly enlarged, fragmentary, cross-sectional view of the closure body and sleeve assembled with the actuator removed.

A third, and presently most preferred, embodiment of the closure of the present invention is illustrated in FIGS. 26 and 27, and the closure is designated generally by the reference number 520 in FIG. 26. The closure 520 is adapted to be mounted on a container, such as the container 21, described above with reference to FIGS. 1 and 2.

The closure includes a closure base or body 524 having a cylindrical lower wall 527 with internal threads 529 (FIG. 27) for engaging mating threads on the container neck. Other suitable engaging means (e.g., snap-fit beads) may be provided to secure the closure body 524 on the container 21. Alternatively, in some applications the closure body 524 could be non-reasonably attached to, or formed unitary with, the container.

An annular sealing ring 530 may be provided as shown in FIG. 27 for engaging an interior edge of the container neck at the container mouth to effect a tight seal.

The closure body 524 includes a transverse end wall 528 defining an outlet passage 540 and a peripheral, frustoconical surface 546 (FIG. 26). The outlet passage 540 is concentric about a central axis 542 (FIG. 27) defined by the frustoconical surface 546 and cylindrical wall 527. Projecting upwardly from the body end wall 528 is an annular seal wall 546 having a circumferential sealing bead 547. The wall 546 extends around, and is concentric with, the outlet passage 540.

The closure body 524 also has a front drive member or post 551 and a rear drive member or post 552 which each project upwardly from the periphery of the end wall 528 at the frustoconical surface 546. Preferably, as with the drive members 51 and 52 described above with reference to the first embodiment illustrated in FIGS. 1–18, the drive members 551 and 552 do not lie on a common diameter. Thus, the shortest circular arc between the nearest sides of the drive members 551 and 552 is less than 180°. The drive members 551 and 552 have substantially the same configuration as the drive members 51 and 52, respectively.

The closure body 524 is adapted to receive a sleeve 580 mounted thereon as illustrated in FIG. 27. To this end, the sleeve 580 includes a cylindrical wall 582 with a plurality of inwardly projecting retainer members 584 which are adapted to slidably engage the frustoconical surface 546 of the closure body 524 as the sleeve 580 is pushed onto the closure body 524. The parts are sufficiently resilient to accommodate a temporary, radial deformation so that the retainer members 584 slip below the peripheral edge of the closure body end wall 528.

The sleeve 580 has a transverse deck 602 which defines a pair of spaced-apart peripheral slots 610 and 612 (FIG. 20) for receiving the drive members 551 and 552, respectively.

The deck 602 has an upwardly facing surface 614 and a downwardly facing surface 616 (FIG. 27). Projecting downwardly from the surface 616 is an annular, seal flange or ring 618. The seal flange 618 sealingly engages the outer surface of the closure body sealing wall bead 547.

The sleeve deck 602 defines a discharge passage 620 (FIG. 27) for communicating with the body outlet passage 540. As illustrated in FIG. 27, the discharge passage 620 is defined within a discharge tube 624.

The sleeve 580 receives a generally disc-like nozzle assembly, actuator means, or actuator 660 (FIG. 26). The actuator 660 is mounted on the sleeve 680 for rotation with the sleeve 680 about the axis 542 (FIG. 27). The actuator 660 includes a transverse top wall 662 and a peripheral flange 664.

At each of two diametrically opposed portions of the flange 664 there is a protuberance or pivot member 666. The pivot members 666 cooperate with the sleeve 580 to mount the actuator 660 for pivoting movement within the sleeve 580. To this end, the inner surface of the sleeve 580 defines two recesses 668 (one recess 668 being visible on the far side in FIG. 27). Each recess 668 mates with one of the pivot members 666 to provide a snap-action engagement of the pivot member 666. This accommodates the pivoting movement of the actuator 660 about a pivot axis defined by the pivot members 666 and receiving recesses 668.

The actuator 660 is substantially identical to the actuator 160 described above with reference to the first embodiment illustrated in FIGS. 1–18. To this end, the actuator 660 is adapted to be tilted between a closed position and an open position (similar to the closed and open positions shown for the first embodiment actuator 160 illustrated in FIGS. 1 and 2).

The actuator 660 includes a channel or nozzle 670 for communicating with the upper end of the sleeve discharge tube 624 when the actuator is in the tilted, open position. When the actuator 660 is closed, the upper end of the discharge tube 624 is sealed closed in the same manner as described above with respect to the first embodiment tube 124 illustrated in FIGS. 1–18.

The actuator 660 includes a structure for cooperating with the body drive members 551 and 552 to open and close the closure 520 when the sleeve 580 is rotated. The structure is the same as in the first embodiment of the actuator 160 described above with reference to FIGS. 1–18.

Specifically, as illustrated in FIG. 26, the actuator 660 includes a front cam rail 708 having a downwardly facing, angled cam surface 710 for engaging the upwardly facing surfaces of the first drive member 551. The actuator 660 also includes a downwardly projecting, rear cam rail 702 having a downwardly angled cam surface 704 for engaging the upwardly facing surfaces of the rear drive member 552.

When the sleeve 580 is rotated, the actuator 660 is carried with the sleeve to move the cam rails 702 and 708 relative to the drive members 551 and 552, respectively. The actuator 660 and drive members 551 and 552 function in substantially the same way as do the first embodiment actuator 160 and drive members 51 and 52 described above with reference to FIGS. 1–18.

The third embodiment illustrated in FIGS. 26 and 27 has unique sealing capabilities. Owing to the sleeve seal flange 618 and the body seal wall 546, the fluid passing from the container through the body outlet passage 540 and sleeve discharge passage 620 is always prevented from leaking out between the sleeve 580 and body 524—regardless of whether the actuator 660 is open or closed.

In all three embodiments of the closure shown in FIGS. 1–27, suitable modifications may be made to employ other forms of actuators instead of the pivotally mounted, tilting actuator illustrated and described.

The closure of the present invention may be fabricated in various suitable configurations for use with a variety of containers, for use with a variety of container/closure attachment modes, and for use in a variety of applications.

The closure of the present invention can be readily molded from thermoplastic materials (e.g., polypropylene and ABS) in a design that provides a "high-style" exterior configuration which is substantially free of functional details.

Indeed, because the closure can be provided with a smooth, cylindrical sleeve surrounding a flat actuator top, a user confronted with such a closure on a container would typically attempt to open the closure by rotating the sleeve in the unscrewing direction (for the conventional right-hand thread which is so widely used throughout the world). Even if the user had not previously used such a closure, the user would undoubtedly attempt to open the closure by unscrewing it in the conventional manner. Of course, this would provide the desired result of the dispensing closure being moved to the dispensing, open orientation.

Because the closure is susceptible to being so easily opened by the ordinary person without special instructions, it is believed that the closure can be effectively used on containers without providing opening instructions. Thus, the exterior of the closure can provide a "high-style", smooth, slick, exterior surface configuration unencumbered by instructional nomenclature or indicia which are so often found on other types of closures.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure for an opening to a container, and closure comprising:

a body that can be located on said container over said opening, said body having a transverse end wall defining an outlet passage through said end wall for communicating with said container opening;

a sleeve mounted on said body for rotation relative to said body about a rotation axis defined by said sleeve, said sleeve having a transverse deck over said body end wall, and said deck defining a discharge passage through said deck offset from said rotation axis for being moved in an arc relative to said body outlet passage when said sleeve is rotated;

an actuator mounted on said sleeve for rotation therewith to occlude flow through said discharge passage from said container when said actuator means is in a closed, non-dispensing position and to permit flow through said discharge passage from said container when said actuator is tilted about a pivot axis to an open, dispensing position; and engaging means defined by said body and said actuator for tilting said actuator between said closed position and said open position while said actuator is rotated with said sleeve.

2. The closure in accordance with claim 1 in which said body is separate from, but releasably attachable to, said container.

3. A dispensing closure for an opening to a container, and closure comprising:

a body that can be located on said container over said opening, said body having an outlet passage for communicating with said container opening and having a pair of upwardly projecting drive members;

a sleeve mounted on said body for rotation relative to said body about a rotation axis defined by said sleeve, said sleeve having a transverse deck over said body, said sleeve deck defining opening means for receiving said drive members which extend therethrough, and said deck also defining a discharge passage through said deck for communicating with said body outlet passage; and an actuator mounted on said sleeve for rotation therewith to occlude flow through said discharge passage from said container when said actuator means is in a closed, non-dispensing position and to permit flow through said discharge passage from said container when said actuator means is tilted about a pivot axis to an open, dispensing position, said actuator including engaging portions for engagement with said body drive members, the engagement between said body drive members and said actuator engaging portions effectively occurring on opposite sides of said pivot axis to effect tilting of said actuator.

4. The closure in accordance with claim 3 in which each said drive member is a post having at least one drive surface inclined relative to a plane that is normal to said rotational axis and having an abutment surface oriented parallel to said plane.

5. The closure in accordance with claim 4 in which the top of each said post has an upwardly open channel.

6. The closure in accordance with claim 4 in which a circular arc between said posts is less than 180°.

7. The closure in accordance with claim 3 in which said actuator engaging portions include two spaced-apart, downwardly projecting cam rails which each have a cam ramp inclined relative to a plane that is normal to said rotation axis.

8. The closure in accordance with claim 7 in which said cam ramps are partially helical and have different inclinations.

9. The closure in accordance with claim 7 in which one of said rails has an abutment surface oriented parallel to said plane.

10. The closure in accordance with claim 7 in which said actuator engaging portions include a planar surface of said actuator from which said cam rails project whereby at least one of said posts engages said planar surface during a part of the rotation of said sleeve and engages one of said cam rails during another part of the rotation of said sleeve.

11. The closure in accordance with claim 3 in which said body is separate from, but releasably attachable to, said container.

12. The closure in accordance with claim 3 in which said sleeve deck opening means includes two spaced-apart slots defined in said deck outwardly of said discharge passage; and one of said drive members projects through one of said slots and the other of said drive members projects through the other of said slots.

13. A dispensing closure for an opening to a container, and closure comprising:

a body that can be located on said container over said opening, said body having an outlet passage for communicating with said container opening and having a pair of upwardly projecting drive members;

a sleeve mounted on said body for rotation relative to said body about a rotation axis defined by said sleeve, said sleeve having a transverse deck over said body, said sleeve deck defining opening means for receiving said drive members which extend therethrough, and said deck also defining a discharge passage through said deck for communicating with said body outlet passage;

an actuator mounted on said sleeve for rotation therewith to occlude flow through said discharge passage from said container when said actuator means is in a closed, non-dispensing position and to permit flow through said discharge passage from said container when said actuator means is tilted about a pivot axis to an open, dispensing position, said actuator including engaging portions for engagement with said body drive members, the engagement between said body drive members and said actuator engaging portions effectively occurring on opposite sides of said pivot axis to effect tilting of said actuator;

said sleeve discharge passage being radially offset from said rotation axis;

said body including a transverse end wall which has a generally planar, upwardly facing, top surface;

said sleeve further including a generally annular seal flange projecting downwardly from said deck bottom surface toward the body end wall top surface; and said body end wall having an annular seal wall projecting upwardly toward said sleeve deck, said annular seal wall being concentric with, and in sealing engagement with, said sleeve seal flange.

14. A dispensing closure for an opening to a container, and closure comprising:

a body that can be located on said container over said opening, said body having a tranverse end wall defining an outlet passage through said end wall for communicating with said container opening;

a sleeve mounted on said body for rotation relative to said body about a rotation axis defined by said sleeve, said sleeve having a transverse deck over said body end wall, and said deck defining a discharge passage through said deck for communicating with said body outlet passage and for being opened and closed;

a seal which is located between said sleeve deck and said body transverse end wall and which extends around said body outlet passage and said deck discharge passage;

an actuator mounted on said sleeve for rotation therewith to occlude flow from said container when said actuator means is in a closed, non-dispensing position and to permit flow from said container when said actuator means is tilted about a pivot axis to an open, dispensing position; and engaging means defined by said body and said actuator for tilting said actuator between said closed position and said open position while said actuator is rotated with said sleeve.

* * * * *